US006603222B2

(12) United States Patent
Loges

(10) Patent No.: US 6,603,222 B2
(45) Date of Patent: Aug. 5, 2003

(54) LOCKING DEVICE FOR LOCK

(75) Inventor: Heinz-Juergen Loges, Aschaffenburg (DE)

(73) Assignee: Robert Bosch GmbH, Stuttgart (DE)

( * ) Notice: Subject to any disclaimer, the term of this patent is extended or adjusted under 35 U.S.C. 154(b) by 36 days.

(21) Appl. No.: 09/950,728

(22) Filed: Sep. 12, 2001

(65) Prior Publication Data

US 2002/0047312 A1 Apr. 25, 2002

(30) Foreign Application Priority Data

Sep. 13, 2000 (DE) ..... 100 45 234

(51) Int. Cl.[7] ..... E05B 47/00

(52) U.S. Cl. ..... 307/147; 70/276; 70/277; 70/279.1

(58) Field of Search ..... 70/276, 277, 279.1; 307/149; 292/144

(56) References Cited

U.S. PATENT DOCUMENTS 5,339,662 A * 8/1994 Goldman ..... 70/277
5,377,513 A * 1/1995 Miyamoto et al. ..... 70/276
6,082,153 A * 7/2000 Schoell et al. ..... 70/1.5

FOREIGN PATENT DOCUMENTS

| | | |
|---|---|---|
| DE | 377 446 | 6/1923 |
| DE | 33 09 962 A1 | 9/1984 |
| DE | 39 41 426 A1 | 6/1991 |
| DE | 42 24 909 A1 | 2/1993 |
| DE | 42 40 560 A1 | 6/1994 |
| DE | 44 22 094 A1 | 1/1996 |
| WO | 99/18311 | 4/1999 |

* cited by examiner

*Primary Examiner*—Shawn Riley
(74) *Attorney, Agent, or Firm*—Michael J. Striker

(57) ABSTRACT

A locking device for a lock has a bolt movable which is lockable and unlockable, a guide for receiving the bolt in a locked position, a latching device which secures the bolt in the locked position against unlocking, a first electrical switch for monitoring a position of the bolt and a second electrical switch for monitoring a position of the latching device, the first electrical switch with the bolt and the second electrical switch with the latching device being mechanically coupled, and a control unit with which the first and second electrical switches are connectable via a first and a second electrical connection.

7 Claims, 2 Drawing Sheets

LOCKING DEVICE FOR LOCK

BACKGROUND OF THE INVENTION

The present invention relates to a locking device for a lock.

Patent document WO 99 18311 discloses a locking device for a lock in which the locking device has a lockable and unlockable bolt. With a latching device the bolt is secured in the locked position against sliding rearwardly. The latching device has a spring which presses a latching element into a groove of the bolt in the locked position.

Patent document DE 42 40 560 A1 discloses an entry control device in which an electronic locking device is connected with a central unit to test calculation data. Patent document DE 42 24 909 C2 discloses a drive rod mount for doors, windows with electrical blocking device, wherein an elastic energy storage means is arranged between the blocking element and the electric drive in order to store energy which is applied for displacement of the blocking element from its blocking position to its release position and vice versa and thereby to make possible this displacement with a time offset, for bringing into operation the electrical drive. Patent document DE 33 09 962 A1 discloses an electrically remotely operated insertion lock, in which a locking bar can be brought with an electric motor to the corresponding desired position. Patent document DE 44 22 094 A1 discloses a lock for doors which is operatable with keys. Patent document DE 33 41 426 A1 discloses a safe locking device with an electromechanical blocking device which is blockable electronically, however can be blocked or unblocked by actuation of a key. Patent document DE PS 377 446 discloses a door lock with an electrically switchable transverse bolt which is under a spring load and provided for locking of a lock trap. The lock trap is locked by a transverse bolt.

SUMMARY OF THE INVENTION

Accordingly, it is an object of present invention to provide a locking device for a lock which is a further improvement of the existing devices of this type.

In keeping with these objects and with others which will become apparent hereinafter, one feature of present invention resides, briefly stated, in a locking device for a lock which has a bolt which is lockable and unlockable; a guide for receiving said bolt in a locked position; a latching device which secures said bolt in the position against unlocking; a first electrical switch for monitoring a position of the bolt and a second electrical switch for monitoring a position of said latching device, said first electrical switch with said bolt and said second electrical switch with said latching device being mechanically coupled; and a control unit with which said first and second electrical switches are connectable via a first and a second electrical connection.

When a locking device for a lock is designed in accordance with the present invention, it has the advantage that an electronic monitoring of the lock is possible, and the monitoring data are then transmitted to a central unit. This makes possible, in particular, in penal institutions, to provide a simple central monitoring for the individual cell doors. Furthermore, there is the advantage that the available latching devices can be easily converted into an inventive locking device.

In accordance with another feature of the present invention, it is especially advantageous when the latching device has an additional semi-cylinder, with which the magnet of the latching device is mechanically unlockable. This is especially advantageous when the electronic system fails, to make possible opening of the door.

In accordance with another feature of the present invention, it is advantageous when the inventive locking device for a lock is combined with door magnets. Therefore, it can be recognized whether the door is open or closed.

It is further advantageous when the latching device has a spring which presses a pin of the latching device into a recess of the bolt, to secure the bolt against unlocking. With electronically controlled magnet of the latching device it is possible to centrally control the latching device. Thereby both a central control as well as an individual control and monitoring of doors is possible.

It is further advantageous when in accordance with another feature of the present invention, the magnet of the latching device is controllable at least in a blocking direction by a control unit.

It is further advantageous when in accordance with another feature of the present invention, several control units are connected with a central unit by a bus, so that a central monitoring and control of doors for a building management is possible.

It is furthermore advantageous when the inventive locking device is incorporated in a frame of a door. Therefore no special structural elements are needed for the locking device.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Doors, in particular in penal institutions for prison cells must be specially secured to prevent breaking out. When the cell doors are closed, they must be secured against an undesirable unlocking. For this purpose, a latching device is utilized. The latching device holds the bolt or key-bolt in the closed position.

In accordance with the present invention, the latching device is additionally electronically monitorable. For this purpose, on the one hand the position of the bolt is monitored via a first electric switch and the position of the latching device is monitored via a second electric switch. With a control unit, it is then indicated what is the condition of the inventive locking device. With an additional semi-cylinder it is possible that the latching device in the case of a failure of the electronic system is mechanically unlockable. Also, the position of the semi-cylinder is monitored by a third electronic switch, and the third electronic switch is also connected with the control unit.

The control unit in accordance with a further embodiment is connected via bus with a central unit, so that the condition of the latching device is indicated at the central unit. With the electronic control unit, it is furthermore possible to remotely control the latching device. Advantageously, the electronic locking device is built in a frame, so that no additional structural elements for the locking device are needed. Also, the semi-cylinder is built in the frame.

Figure 1:
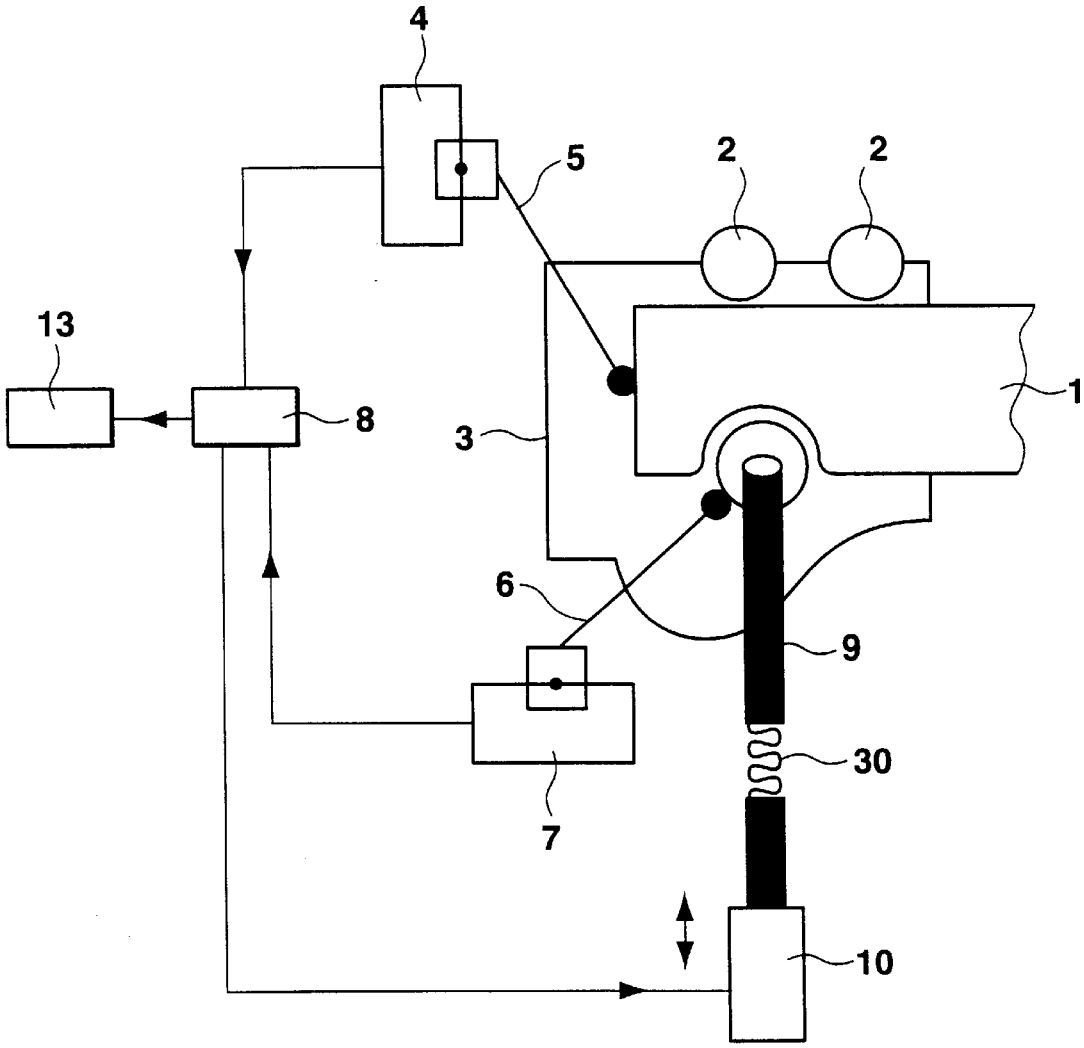
FIG. 1 is a view showing a locking device in accordance with the present invention.

FIG. 1 schematically shows the locking device. A bolt 1 of a lock during locking is moved in a guide 3 which is located in a frame, and the guide 3 has guiding rollers 2 which facilitate the moving-in of the bolt 1. The bolt 1 is mechanically coupled through a spring 5 with a first electrical switch 4. Through this mechanical coupling, when the bolt 1 is moved in, the electrical switch 4 is switched over, so that the moving-in leads to an electrical signal. The bolt 1 has a recess, in which the latching device formed as a pin is pressed in when the bolt 1 is closed.

The latching device 9 is connected through a spring 6 with a second electrical switch 7, so that during pressing-in of the latching device 9 the switch 7 is actuated, and also the pressing-in of the latching device 9 also leads to an electrical signal. Through a magnet 10 which is connected with the latching device via a spring 30, the latching device 9 is moved to a position, so that through the spring 30 of the latching device 9, the latching device 9 can be pressed into the recess of the bolt 1. The spring 30 of the latching device 9 mechanically pretensions the latching device 9 and releases during moving upwardly the latching device 9 in the recess of the bolt 1.

With the magnet 3, it is furthermore possible that the latching device 9 is moved back, so that a pressing-in in the recess of the bolt 1 is no longer possible. Then an unlocking of the bolt 1 is possible. The actuation of the magnet 10 can be performed electrically through a control unit 8. If the control unit 8 fails, then a semi-cylinder is provided which is known in conventional doors. It makes possible moving of the magnet 10 mechanically forwardly and rearwardly to actuate the latching device 9 or to remove it. The semi-cylinder and a switch which is mechanically coupled with the semi-cylinder are not shown, and the locking and unlocking of the semi-cylinder is transmitted through the switch as an electrical signal to the control unit 8. The semi-cylinder is known in house doors, in which the house key is introduced to lock the house door. The electrical switches 4 and 7 as well as the electrical switch which monitors the semi-cylinder are here formed as microswitches.

The control unit 8 has a first input, and the first electrical switch 4 is connected to it. The second electrical switch 7 is connected to a second input of the control unit 8. The electrical switch for the semi-cylinder is connected with a not shown third input. The magnet 10 is connected to an output of the control unit 8 for moving the magnet 10 forwardly and rearwardly. This is achieved with a pulse. Thereby the magnet 10 is moved forwardly and rearwardly by means of magnetic energy.

An indicator 13 is connected to a second output of the control unit 8. It indicates the operation and the condition of the inventive locking device. For example, by lights of corresponding light-emitted diodes, in indicating conditions, failure, unlocking or locking conditions are shown. Also, a comfortable indication is possible, which indicates the condition of the inventive locking device in words or symbols.

Figure 2:
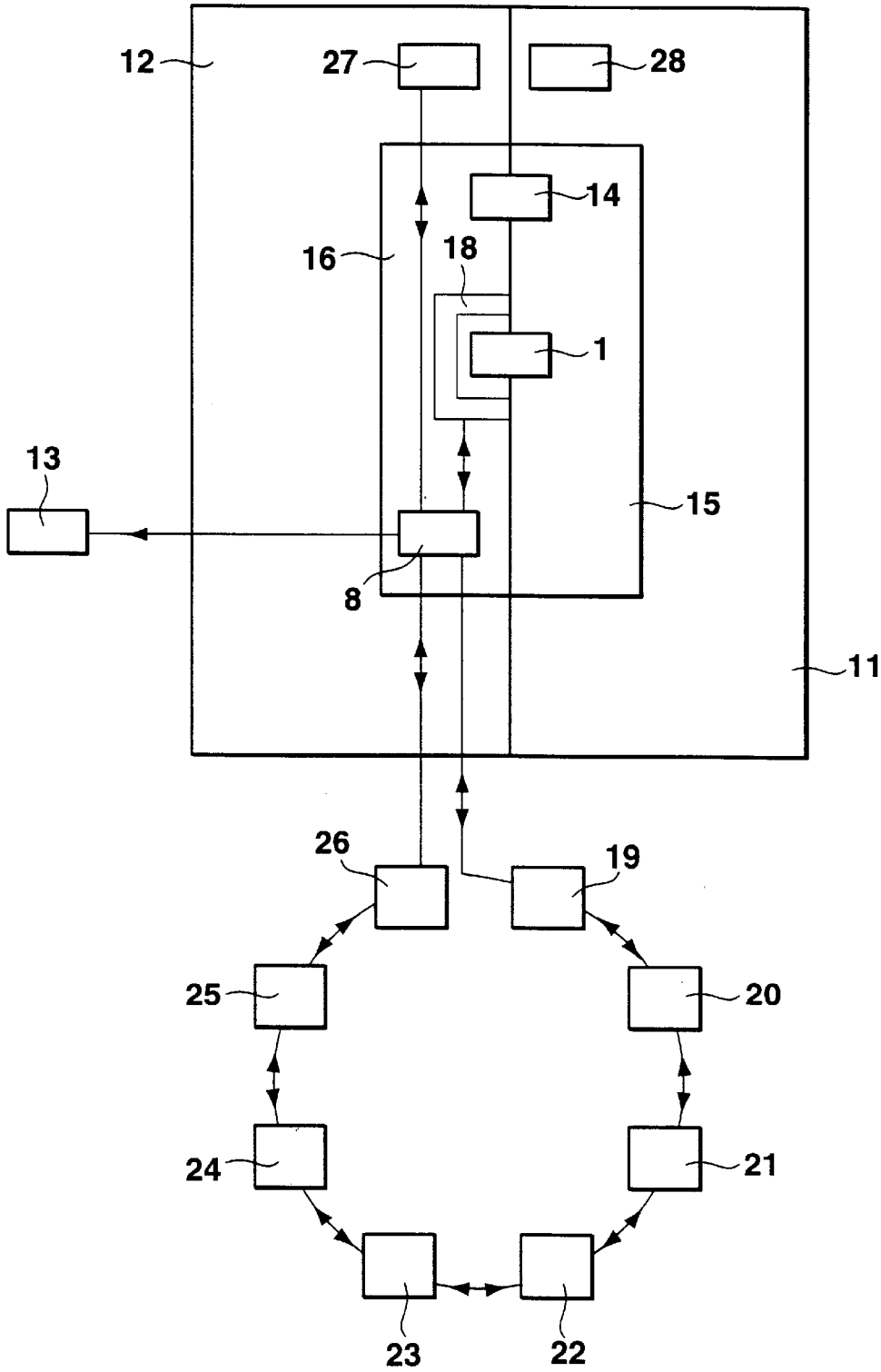
FIG. 2 is a view showing the inventive locking device as a part of a building management system.

FIG. 2 shows the inventive locking device as a part of a building management system. The bolt 1 is moved forwardly and rearwardly by a door 15 in the inventive latching device 18 which is located in a door frame 16. The locking device 18 includes here a guide 3 with guiding rollers 2, the latching device 9 with the magnet 10, the electrical switched 4 and 7, as well as the semi-cylinder with the third electrical contact. The locking device 18 is connected with the control unit 8 which is shown in FIG. 1. The control unit 8 is connected through an output with the indicator 13 and through an output with a door magnet 27, and indicates whether the door is in a closed or an open condition.

The lock 15 is located in a door 11, while the latching device 16 is located in a frame, which also has the door magnet 27. The indicator 13 is arranged here for example on a wall near the frame 12. The door 11 has a counterpiece to the door magnet 27, namely a further magnet 28, to release correspondingly the signal, when the door 11 is closed. The door 11 in its lock 15 also has a trap 14 which is spring-biased and caught during closing of the door. The trap 14 is lockable via the lock 15. Alternatively, it can be provided that the trap 14 is dispensed with.

The control unit 8 is connected to a bus, for example the known local safety network bus. This is a seriel bus to which other components are connected via a building management system. These other components are the bus stations 19, 20, 21, 23, 24, 25, 26 which are also control units for other locking devices and are connected through the bus to a central unit 22. They transmit data to the central unit 22 and are actuatable by the individual locking devices, as described herein above for the latching device 9 in FIG. 1.

During the monitoring of the locking device, it is monitored whether the door 1 is already closed, and via the door magnet 27, whether the bolt 1 is moved in, whether the magnet 10 is moved out in the locking direction, whether a sabotage takes place and/or a time period of opening and closing of the inventive locking device.

The process of locking the door is as follows:

First the door 11 is closed. Then the lock 15 is closed and the bolt 1 is moved out. The magnet 10 is then controlled, to move the latching device 9 into the groove of the bolt 1. Thereby the bolt 1 is mechanically locked.

During opening, the process is as follows:

The magnet 10 is unlocked via the control unit 8, so that the latching device 9 is withdrawn from the groove and the bolt 1 is thereby unlocked. Then the bolt 1 is moved back, and the lock can be opened.

It will be understood that each of the elements described above, or two or more together, may also find a useful application in other types of constructions differing from the types described above.

While the invention has been illustrated and described as embodied in latching device for lock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A locking device for a lock, comprising a bolt which is lockable and unlockable; a guide for receiving said bolt in a locked position; a latching device which secures said bolt in the position against unlocking; a first electrical switch for monitoring a position of the bolt and a second electrical switch for monitoring a position of said latching device, said first electrical switch with said bolt and said second electrical switch with said latching device being mechanically coupled; and a control unit with which said first and second electrical switches are connectable via a first and a second electrical connection, said latching device having a spring which is connected with a magnet controllable by said control unit, said bolt having a recess in which said latching device is movable by said controllable magnet, said control unit controlling said magnet at least in a latching position for actuation of said latching device; and means for connecting said control unit with a central control unit for providing a central control of the locking device.

2. A locking device as defined in claim 1; and further comprising a third electrical switch which monitors a position of a semi-cylinder, said first electrical switch being coupled with said semi-cylinder mechanically and said semi-cylinder being coupled with said latching device mechanically, said second electrical switch being connectable with said control unit via a third electrical connection.

3. A locking device as defined in claim 1; and further comprising a fourth electrical connection through which said control unit is connectable with a door magnet monitoring a position of a door.

4. A locking device as defined in claim 1, wherein said magnet is movable back via a semi-cylinder.

5. A locking device as defined in claim 1, wherein said connecting means include a bus for connecting said control unit with said central control unit.

6. A locking device as defined in claim 1; and further comprising means for mounting the locking device in a door frame.

7. A locking device as defined in claim 2, wherein the locking device is formed so that in the event of a failure of a current supply and/or a magnet, said bolt is mechanically is latchable and unlatchable.

* * * * *